United States Patent [19]

Block

[11] 4,377,078

[45] Mar. 22, 1983

[54] CHAIN AND END ATTACHMENT MEANS

[75] Inventor: Alvin Block, Bedford, N.Y.

[73] Assignee: Intimate Jewels, Inc., Katonah, N.Y.

[21] Appl. No.: 291,221

[22] Filed: Aug. 4, 1981

[51] Int. Cl.[3] ..... A44C 11/02

[52] U.S. Cl. ..... 63/2; 24/116 A

[58] Field of Search ..... 63/2, 4; 24/115 M, 116 A, 24/136 L; 59/93

[56] References Cited

U.S. PATENT DOCUMENTS

| | | | |
|---|---|---|---|
| 1,465,759 | 8/1923 | Dey | 24/116 A X |
| 1,496,147 | 6/1924 | Cook | 24/116 A |
| 1,504,761 | 8/1924 | Hubbell | 24/116 A |
| 1,650,505 | 11/1927 | Gagnon | 24/116 A |
| 1,907,933 | 5/1933 | Crockett | 24/116 A X |
| 4,078,277 | 3/1978 | McCracken | 24/115 M |

*Primary Examiner*—F. Barry Shay

*Attorney, Agent, or Firm*—Kirschstein, Kirschstein, Ottinger & Cobrin

[57] ABSTRACT

A keeper for detachably attaching the two ends of a length of flexible linear solid chain, such as a necklace or a bracelet, to each other. A spherical ball at one end of the chain is inserted into a deformable clamp which is attached to the other end of the chain. The clamp has two arms which detachably engage the ball. A frusto-conical keeper element is freely mounted about the chain length adjacent the clamp; the keeper element converges and tapers away from the clamp, so that when the clamp with engaged ball is displaced into the keeper element by concomitantly pulling the keeper element and the other end of the chain away from each other, the clamp and engaged spherical ball are tightly fitted into the keeper element. The outer surface of each curved arm of the clamp thus engages the inner surface of the keeper element, so that the two chain ends are detachably attached to each other, and cannot be separated from each other, except by pulling the one end of the chain length away from the keeper element.

7 Claims, 6 Drawing Figures

FIG.1
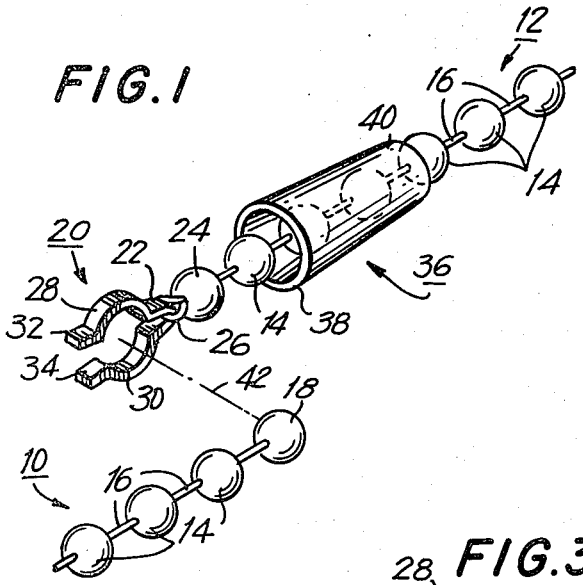
FIG.2
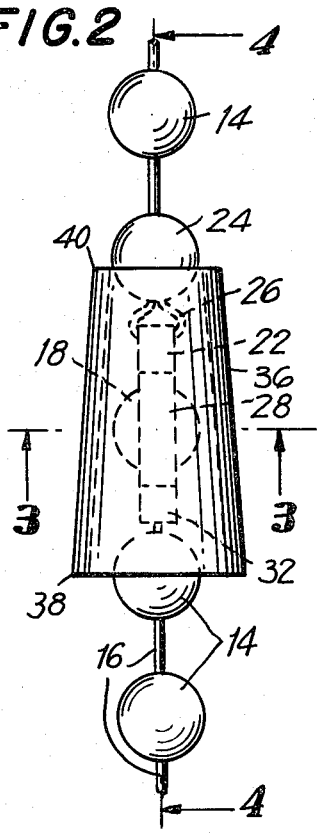
FIG.3a
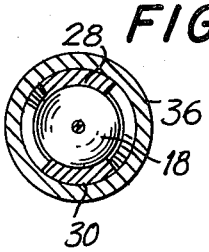
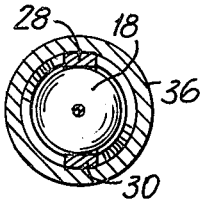
FIG.3
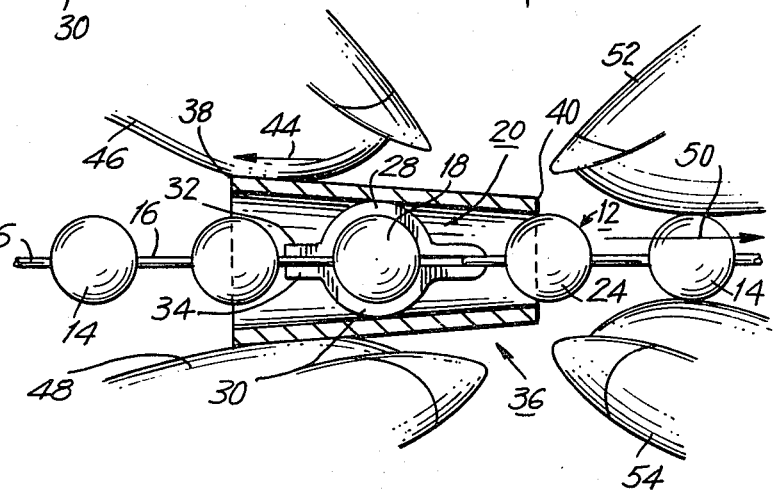
FIG.4
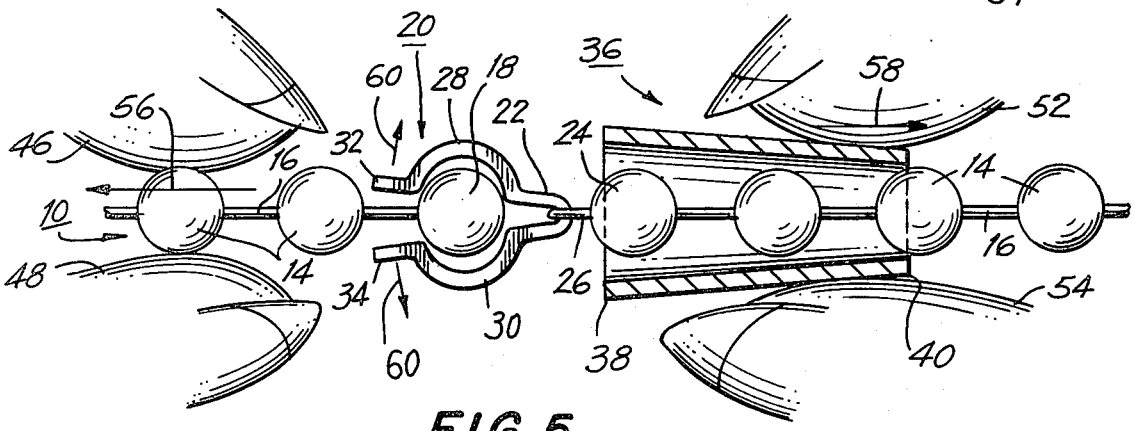
FIG.5

CHAIN AND END ATTACHMENT MEANS

BACKGROUND OF THE INVENTION

1. Field of the Invention

A safety chain keeper for detachably attaching the two ends of a length of flexible linear jewelry or the like, such as a chain bracelet or a necklace, to each other.

2. Description of the Prior Art

Chain bracelets, necklaces and similar lengths of flexible linear chain jewelry have been worn by women for purposes of adornment ever since the earliest civilizations. Bracelets, necklaces, and other appurtenances designed to be worn on the wrist or around the neck have been found in numerous archeological excavations, and to this day even primitive societies such as the Eskimos or the natives in jungles or on isolated islands have adopted such ornaments. The purpose of bracelets or necklaces is primarily for the decoration of the individual, and such ornaments together with suitable matching earrings provide a pleasing appearance and heighten the attractiveness of the individual. Thus bracelets and necklaces, albeit not having any utilitarian function, are important articles of the jewelry trade, and are significant articles of commerce and manufacture.

Most chain bracelets and necklaces are basically a length of flexible linear solid chain with two ends, and various prior art devices and means have been developed to attach these two ends to each other after the chain bracelet has been mounted to encircle the wrist, or after the necklace has been mounted to encircle the neck. These devices and means include a simple hooked catch in which a hook at one end is extended through a loop at the other end; catches relying on the resilience of a member for detachable attachment, e.g., a resilient metal hook or bow is forced into a receiving compartment so that it snaps into place, and may be removed only by manually deforming the hook or bow; threaded attachment means in which a threaded pin at one end is screwed into a nut fixed to the other end of the chain, and various other snap-fit attachments.

SUMMARY OF THE INVENTION

1. Purposes of the Invention

It is an object of the present invention to provide an improved safety chain keeper for chain bracelets, necklaces, and similar items of jewelry.

Another object is to provide a safety chain keeper by which the two ends of a length of flexible linear solid chain may be effectively and detachably attached to each other.

A further object is to provide a safety chain keeper which is rugged and reliable in operation and is of low cost.

An additional object is to provide a safety chain keeper which is readily and simply fabricated and assembled in mass production facilities using unskilled labor.

Still another object is to provide a safety chain keeper which is reliable in performance, so that the loss of valuable items of jewelry is effectively prevented.

An object is to provide a safety chain keeper which effectively attaches two ends of a length of flexible linear solid chain, such as chain bracelets or necklaces, to each other, so that the wearer of such items of jewelry does not have to fear the loss of the precious jewelry item due to failure of the ends attachment.

An object is to provide a safety chain keeper which is simpler than, but works as well as, prior art designs of greater complexity.

An object is to provide a safety chain keeper which is competitive in performance and cost to known keepers now on the market.

An object is to provide a safety chain keeper which is easily manipulated, and the mode of operation of which is readily comprehended, by old and young alike.

An object is to provide an improved safety chain keeper for detachably attaching the two ends of a length of flexible linear jewelry chain or the like, such as chain bracelet or a necklace, to each other.

An object is to provide a detachably attachable safety chain keeper which cannot open inadvertently, but may only be opened by a conscious manipulation of the elements of the device.

An object is to prevent the loss of chain-type jewelry such as chain bracelets and necklaces, by providing an effective and fail-proof safety keeper for detachably attaching together the two ends of the chain.

An object is to provide a safety chain keeper which is self-locating into the detachable attachment setting.

An object is to provide a safety chain keeper which is shaped to provide a stronger attachment and a better detachable attachment effect.

An object is to provide a safety chain keeper in which the elements are cammed into the attachment position.

An object is to provide a safety chain keeper which cannot be dislodged from the attachment setting by strenuous physical activity or the like.

An object is to provide a safety chain keeper which is readily emplaced into the attachment disposition, and yet is not easily accidentally dislodged when once emplaced, and can only be separated by a positive and conscious effort.

An object is to provide a safety chain keeper which may be readily stamped out or otherwise formed from metal sheet and tube, and which thus is capable of being produced at low cost in mass production facilities using unskilled labor.

These and other objects and advantages of the present invention will become evident from the description which follows.

2. Brief Description of the Invention

In the present invention, a safety chain keeper configuration is contemplated for detachably attaching the two ends of a length of flexible linear solid chain to each other. The safety chain keeper includes a length of flexible linear solid chain having two ends, such as a chain bracelet or necklace. A generally spherical member, e.g., a ball, is permanently mounted to one end of the chain length. One end of a deformable clamp is permanently mounted to the other end of the chain length, and the other free end of the clamp has two discrete and spaced apart end portions. The middle portion of the clamp, between the one clamp end and the other free clamp end, is of generally circular shape, to accommodate the ball or other spherical member mentioned supra, and includes two curved arms.

A frusto-conical keeper element is freely mounted about the chain length and adjacent to the clamp. The keeper element tapers and converges away from the clamp, to a terminal diameter which is dimensionally less than the diameter of the spherical member plus the thickness of the two arms of the middle portion of the clamp. The other terminal diameter of the keeper element, i.e., adjacent the clamp, is dimensionally equal to or greater than the diameter of the spherical member plus the thickness of the two arms.

These two arms of the middle portion of the clamp are resiliently deformable away from each other, so that when the spherical member is inserted into the clamp and between the two arms, the clamp deforms and the two arms detachably engage the spherical member. Thereafter, when the clamp with engaged spherical member is displaced into the keeper element, by concomitantly pulling the keeper element and the other free end of the chain length away from each other, the clamp and engaged spherical member are tightly fitted and wedged into the keeper element, with the outer surface of each curved arm of the middle portion of the clamp engaging the inner surface of the keeper element. Thus, the two ends of the length of flexible linear solid chain are detachably attached to each other, and cannot be separated from each other, except by pulling the one end of the chain length away from the keeper element to disengage the elements.

In a preferred embodiment, the spherical member is hollow, e.g., a hollow ball, however in other embodiments the spherical member could be a solid ball-shaped element, e.g., a pearl. Typically, the free end of each curved arm of the middle portion of the clamp is provided with a terminal finger, with each finger extending linearly away from the one end of the clamp. The curved arms of the middle portion of the clamp may be flat and rectilinear in cross-section, or the curved arms may be curved in cross-section, with the cross-sectional curvature of the arms conforming to the curved outer surface of the spherical member. In one embodiment of the invention, the spherical member is a terminal one of a plurality of generally identical spherical members flexibly linked to each other, e.g., a string of pearls, and the terminal diameter of the larger inlet end of the keeper element in this case will be greater than the diameter of any one spherical member, so that in practice, more than one spherical member is disposed in the keeper element when the two ends of the chain are detachably attached to each other. Typically the length of flexible linear solid chain is contemplated as being a chain bracelet, necklace, or like piece of jewelry.

The device and article of manufacture of the present invention provides many salient advantages. The present improved safety chain keeper for chain bracelets, necklaces, and the like items of jewelry enables the two ends of a length of flexible linear solid chain to be effectively and detachably attached to each other. The device is rugged and reliable in operation and is of low cost. The device is readily and simply fabricated and assembled in mass production facilities using unskilled labor. The device is reliable in performance, so that the loss of valuable items of jewelry is effectively prevented. The present safety chain keeper effectively attaches the two ends of a length of flexible linear solid chain, such as chain bracelets or necklaces, to each other, so that the wearer of such items of jewelry does not have to fear the loss of the precious jewelry item due to failure of the ends attachment. The device is simpler than, but works as well as, prior art designs of greater complexity. Thus the device is competitive in performance and cost to known keepers now on the market. The device is easily manipulated, and its mode of operation is readily comprehended by old and young alike. The device is an improved safety chain keeper for detachably attaching the two ends of a length of flexible linear jewelry chain or the like, such as a chain bracelet or a necklace, to each other.

Other advantages include the fact that the device is a detachably attachable safety chain keeper which cannot open inadvertently, but may only be opened by a conscious manipulation of the elements of the device. The present device prevents the loss of chain-type jewelry such as chain bracelets and necklaces, by providing an effective and fail-proof safety keeper for detachably attaching together the two ends of the chain. Moreover, the device is shaped to provide a stronger attachment and a better detachable attachment effect.

The elements of the device are cammed into the attachment position, so that it is easy to attach the chain ends to each other. The device cannot be dislodged from the attachment setting by strenuous physical activity or the like. The device is readily emplaced into the wedged attachment disposition, and yet is not easily accidentally dislodged when once emplaced, and can only be separated by a positive and conscious effort. The present safety chain keeper may be readily stamped out or otherwise formed from metal sheet and tube, and thus the device is amenable to being produced at low cost in mass production facilities using unskilled labor.

The invention accordingly consists in the features of construction, combination of elements, and arrangement of parts, which will be exemplified in the device and article of manufacture hereinafter described, and of which the scope of application is as elucidated supra and as will be indicated in the appended claims.

BRIEF DESCRIPTION OF THE DRAWINGS

In the accompanying drawings in which are shown several of the various possible embodiments of the invention:

FIG. 1 is a perspective view of the present safety chain keeper, showing the several elements of the device prior to attachment;

FIG. 2 is a plan view of the device with the keeper elements now detachably attached to each other;

FIG. 3 is a sectional elevation view taken substantially along the line 3—3 of FIG. 2;

FIG. 3*a* is similar to FIG. 3 but shows an alternate embodiment of the invention;

FIG. 4 is an elevation view showing the mode of detachably attaching the safety chain keeper elements together; and FIG. 5 is an elevation view showing the mode of subsequently detaching the safety chain keeper elements from each other, so as to separate the ends of the chain from each other, e.g., when the wearer of the chain desires to remove the chain bracelet or necklace from her person.

DETAILED DESCRIPTION OF THE PREFERRED EMBODIMENTS

Referring now to the Figures, a typical embodiment of the invention includes a length of flexible linear solid chain having two ends generally designated as 10 and 12. In the embodiment shown, the chain is composed of a plurality of generally equal sized and identical hollow spherical members 14, which are swivelably and pivotably connected to each other as by swivel chain links 16. The members 14 basically consist of hollow spherical balls composed e.g., of gold, however, the members 14 could alternatively consist of pearls, beads made of jade, semi-precious stones, ceramic, or the like.

In accordance with the present invention, the safety chain keeper for detachably attaching the two ends 10 and 12 of the length of flexible linear solid chain 14 to each other includes the generally spherical member 18 which may be dimensionally equal or equivalent to the elements 14 but is characterized by being permanently mounted to and at the one end 10 of the chain length.

A deformable clamp generally designated as 20 is mounted to and at the other end 12 of the chain length, and more specifically, the end 22 of the clamp 20 is permanently mounted to the end spherical member 24 of the other end 12 of the chain length via looped linkage 26. The other, free end of the clamp 20 has two discrete and spaced apart end portions including curved arms 28 and 30 which are provided, respectively, with terminal fingers 32, 34, the terminal fingers 32 and 34 extending linearly away from the one end 22 of the clamp 20, and defining the terminus of the other free end of the clamp 20. As shown, the middle portion of the clamp 20, between the one end 22 and the terminal fingers 32, 34 is of generally circular shape, to accommodate insertion of the spherical member 18.

A frusto-conical keeper element, generally designated as 36, is freely mounted about the chain length, and more specifically about end 12 and adjacent the clamp 20. As shown, the keeper element 36 tapers and converges away from the end 38 adjacent the clamp 20, to the end 40 spaced away from the clamp 20. Basically, the keeper element 36 tapers and converges away from the clamp 20 to a terminal diameter at the one end 40 which is less than the diameter of the spherical member 18 plus the thickness of the two arms 28 and 30, the other end 38 of the keeper element 36 having a diameter greater than the diameter of the spherical member 18 plus the thickness of the two arms 28 and 30.

These two arms 28 and 30 of the middle portion of the clamp 20 are resiliently and flexibly deformable away from each other, e.g. the arms 28 and 30 are springy and pivot about the end 22. Thus, when the end spherical member 18 is inserted into the clamp 20 and between the two arms 28 and 30, as indicated by the phantom line 42 (FIG. 1), the clamp 20 deforms and the two arms 28 and 30 detachably engage the spherical member 18. Thereafter, as shown in particular in FIG. 4, when the clamp 20 with engaged spherical member 18 is displaced into the keeper element 36, the clamp 20 and engaged spherical member 18 are tightly fitted into the keeper element 36. This is accomplished by concomitantly pulling the keeper element 36 in the direction shown by arrow 44 (FIG. 4), employing fingers 46, 48, while pulling the other free end 12 of the chain length in the direction shown by arrow 50 employing fingers 52, 54. Thus, as seen in FIG. 4, the keeper element 36 and the other free end 12 of the chain length are concomitantly pulled away from each other, via oppositely acting arrows 44 and 50. As shown in FIG. 4, the outer surface of each curved arm 28, 30 of the middle portion of the clamp 20 engages the inner surface of the keeper element 36, so that a wedging action takes place with frictional engagement, and so that the clamp 20 with engaged spherical member 18 is tightly wedged into the keeper element 36. Thus, as shown in FIGS. 3 and 4, the two ends 10 and 12 of the length of flexible linear solid chain are detachably attached to each other within the keeper element 36.

The subsequent separation of the two ends 10 and 12, when desired, is shown in FIG. 5. Here the fingers 46 and 48 have grasped the one free end 10 of the chain length, and the fingers 46, 48 are pulling the end 10 in the direction indicated by arrow 56, and away from the keeper element 36, while concomitantly the fingers 52 and 54 have grasped the keeper element 36, and the fingers 52, 54 are pulling the keeper element 36 in the direction indicated by arrow 58, and away from the one free end 10 of the chain length. As the clamp 20 emerges from the keeper element 36, the clamp 20 is released from the wedged disposition and the arms 28 and 30 spring apart, as shown by arrows 60, thus releasing the end spherical member 18 for removal from between the arms 28 and 30. In summary, FIG. 5 shows how the two ends 10, 12 of the length of flexible linear solid chain are separted from each other by pulling the one end 10 of the chain length away from the keeper element 36.

FIG. 3 shows one embodiment of the curved arms 28 and 30, namely with the arms 28 and 30, being flat and rectilinear in cross-section. FIG. 3*a* shows an alternative embodiment of the curved arms 28 and 30, namely with the arms 28 and 30 being curved in cross-section, with the cross-sectional curvature of the arms 28 and 30 conforming to the curved outer surface of the spherical member 18.

It thus will be seen that there is provided a safety chain keeper device as an article of manufacture which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A safety chain keeper for detachably attaching the two ends of a length of flexible linear solid chain to each other which comprises a substantially spherical member, said spherical member being permanently mounted to one end of said chain length, a deformable clamp, one end of said clamp being mounted to the other end of said chain length, the other free end of said clamp having two discrete and spaced apart end portions, the middle portion of said clamp between said one clamp end and said other free clamp end being of substantially circular shape and comprising two curved arms, and a frusto-conical keeper element, said keeper element being freely mounted about said chain length adjacent said clamp, said keeper element tapering and converging away from said clamp to a terminal diameter at one end less than the diameter of said spherical member plus the thickness of the two arms of the middle portion of said clamp, the other end of said keeper element having a diameter greater than the diameter of said spherical member plus the thickness of the two arms of the middle portion of said clamp, said two arms of the middle portion of said clamp being resiliently biased away from each other, so that when said spherical member is inserted into said clamp between said two arms, said clamp is adapted to deform and said two arms to detachably engage said spherical member, and so that when said clamp with engaged spherical member is displaced into said keeper element, by concomitantly pulling said keeper element and said other end of said chain length away from each other, the clamp and engaged spherical member are tightly fitted and wedged into said keeper element, the outer surface of each curved arm of the middle portion of said clamp engaging the inner surface of said keeper element, so that the two ends of the length of flexible linear solid chain are detachably attached to each other and cannot be separated from each other except by pulling the one end of said chain length away from said keeper element.

2. The safety chain keeper of claim 1 in which the spherical member is hollow.

3. The safety chain keeper of claim 1 in which the free end of each curved arm of the middle portion of the clamp is provided with a terminal finger, each finger extending linearly away from the one end of the clamp.

4. The safety chain keeper of claim 1 in which the curved arms of the middle portion of the clamp are flat and rectilinear in cross-section.

5. The safety chain keeper of claim 1 in which the curved arms of the middle portion of the clamp are curved in cross-section, the cross-sectional curvature of the arms conforming to the curved outer surface of the spherical member.

6. The safety chain keeper of claim 1 in which the spherical member is a terminal one of a plurality of substantially identical spherical members flexibly linked to each other, and the terminal diameter of the keeper element at the one end is greater than the diameter of a spherical member.

7. The safety chain keeper of claim 1 in which the length of flexible linear solid chain is a necklace or a bracelet.

* * * * *